US009635998B2

(12) United States Patent
Dowell

(10) Patent No.: US 9,635,998 B2
(45) Date of Patent: May 2, 2017

(54) SHOE DRYING ASSEMBLY

(71) Applicant: Lula Dowell, Mason, TN (US)

(72) Inventor: Lula Dowell, Mason, TN (US)

( * ) Notice: Subject to any disclaimer, the term of this patent is extended or adjusted under 35 U.S.C. 154(b) by 0 days.

(21) Appl. No.: 14/845,940

(22) Filed: Sep. 4, 2015

(65) Prior Publication Data

US 2017/0065149 A1 Mar. 9, 2017

(51) Int. Cl.
*D06F 58/04* (2006.01)
*A47L 23/20* (2006.01)

(52) U.S. Cl.
CPC ..... *A47L 23/20* (2013.01)

(58) Field of Classification Search
CPC .. F26B 1/00; F26B 19/00; F26B 25/00; D06F 58/00; D06F 58/12; D06F 58/04; A47L 23/20
USPC ..... 34/61, 90; D32/36; 248/206.5
See application file for complete search history.

(56) References Cited

U.S. PATENT DOCUMENTS 4,702,016 A 10/1987 Grigsby et al.
4,813,641 A * 3/1989 Wilson ..... D06F 58/04 248/206.2
5,024,408 A 6/1991 Magee
D335,008 S 4/1993 Abel
5,220,734 A 6/1993 Carver
5,623,769 A 4/1997 Hayden
5,743,025 A 4/1998 Jordan, Jr.
6,067,723 A * 5/2000 Lafrenz ..... D06F 58/04 34/106
6,115,936 A * 9/2000 Arlie ..... D06F 58/04 34/106
6,374,509 B1 4/2002 Jackson, Sr. et al.
6,845,569 B1 * 1/2005 Kim ..... A47L 23/20 34/106
8,914,991 B2 * 12/2014 Jackson ..... A47L 23/205 34/600
2009/0300934 A1 12/2009 Hesse et al.
2010/0064544 A1 * 3/2010 Luong ..... D06F 58/04 34/239

FOREIGN PATENT DOCUMENTS

CA 2384946 A1 * 12/2002 ..... A47L 23/205
KR 101476008 B1 * 12/2014

* cited by examiner

*Primary Examiner* — Stephen M Gravini

(57) ABSTRACT

A shoe drying assembly includes a panel that may have a shoe placed thereon. The panel engages an inner wall of a dryer thereby inhibiting the shoe from tumbling when the dryer is turned on. A coupler is coupled to the panel such that the coupler may magnetically engage the inner wall of the dryer. A first set of straps is provided and a second set of straps is provided. Each of the first set of straps and the second set of straps is coupled to the panel. Thus, each of the first set of straps and the second set of straps may be positioned over the shoe when the shoe is positioned on the panel. Each of the second set of straps is matable with an associated one of the first set of straps.

5 Claims, 3 Drawing Sheets

SHOE DRYING ASSEMBLY

BACKGROUND OF THE DISCLOSURE

Field of the Disclosure

The disclosure relates to drying devices and more particularly pertains to a new drying device for inhibiting a shoe from tumbling when the shoe is dried in a clothes dryer.

SUMMARY OF THE DISCLOSURE

An embodiment of the disclosure meets the needs presented above by generally comprising a panel that may have a shoe placed thereon. The panel engages an inner wall of a dryer thereby inhibiting the shoe from tumbling when the dryer is turned on. A coupler is coupled to the panel such that the coupler may magnetically engage the inner wall of the dryer. A first set of straps is provided and a second set of straps is provided. Each of the first set of straps and the second set of straps is coupled to the panel. Thus, each of the first set of straps and the second set of straps may be positioned over the shoe when the shoe is positioned on the panel. Each of the second set of straps is matable with an associated one of the first set of straps.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
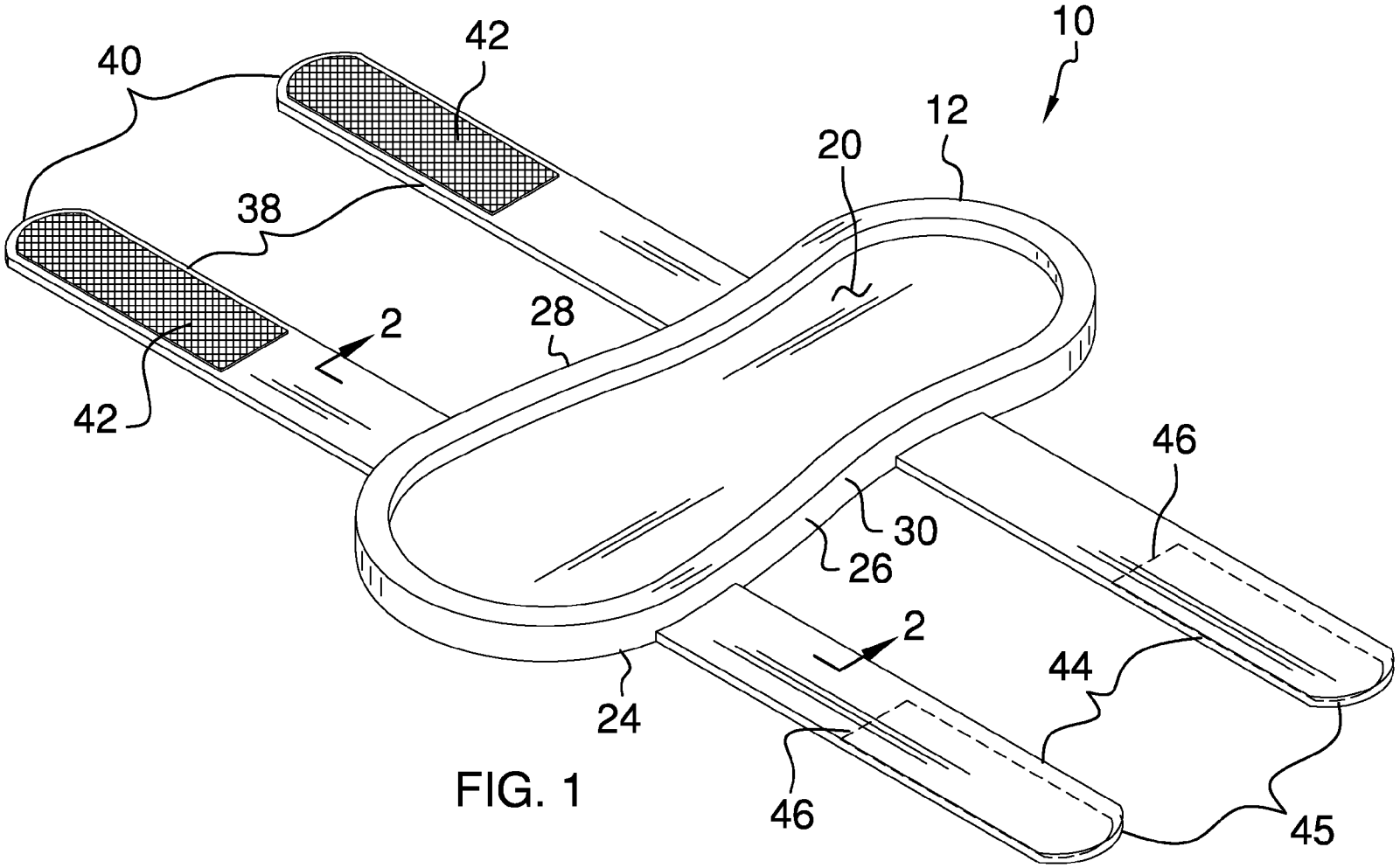
FIG. 1 is a top perspective view of a shoe drying assembly according to an embodiment of the disclosure.
Figure 2:
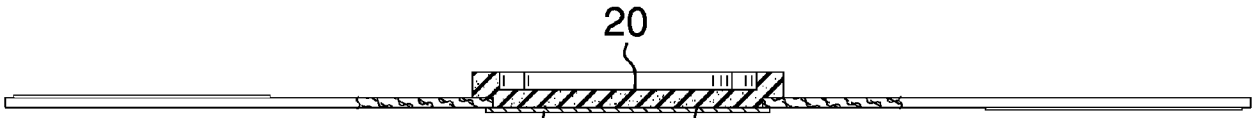
FIG. 2 is a cross sectional view taken along line 2-2 of FIG. 1 of an embodiment of the disclosure.
Figure 3:
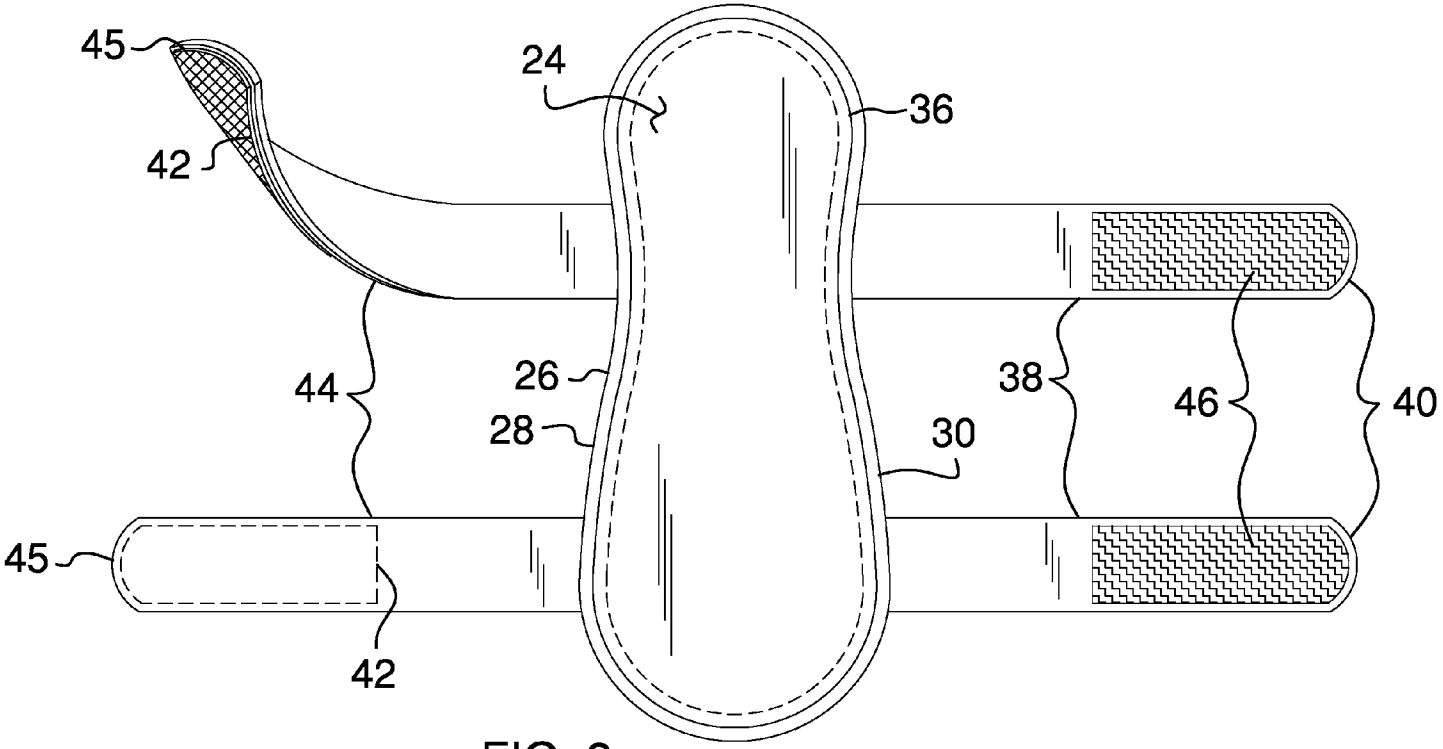
FIG. 3 is a bottom view of an embodiment of the disclosure.
Figure 4:
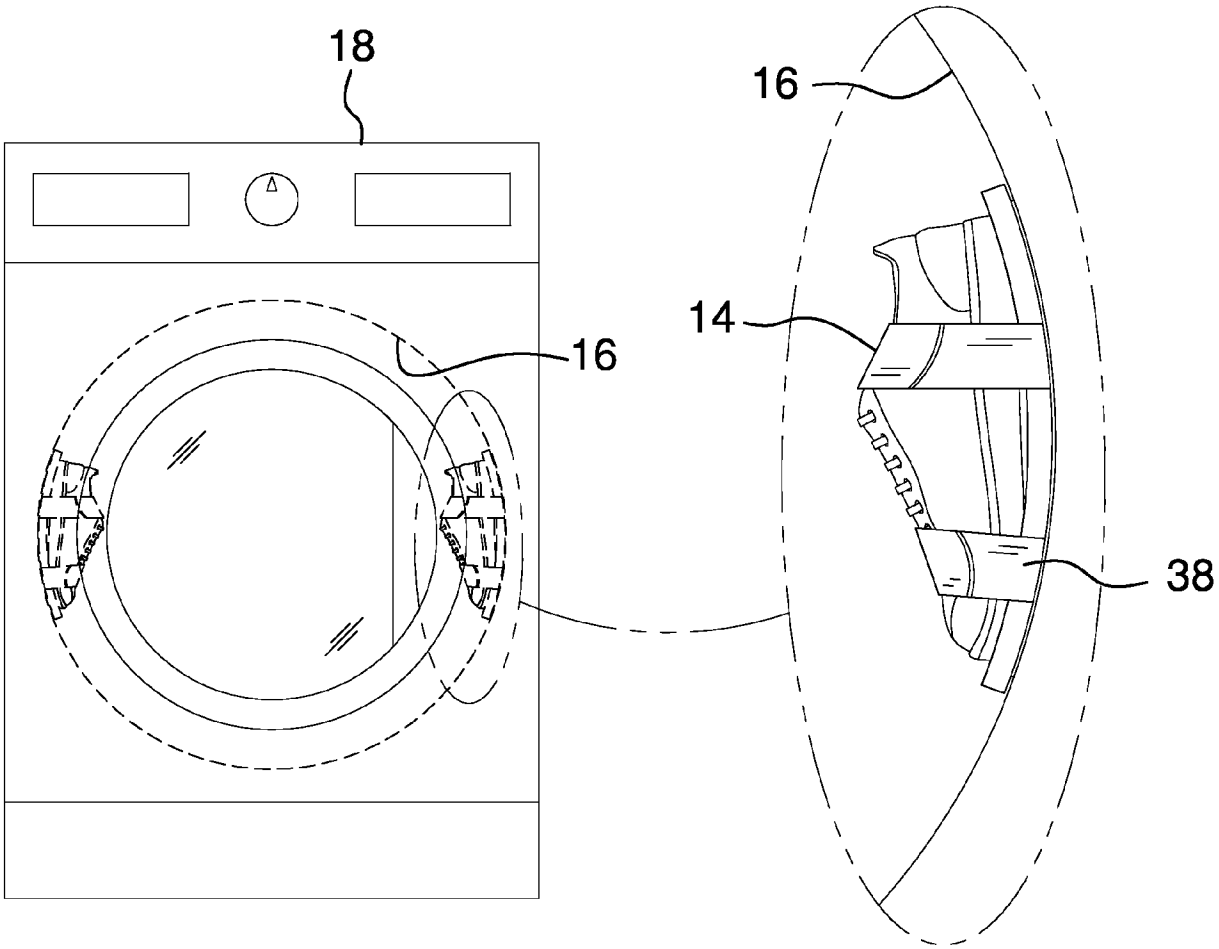
FIG. 4 is a perspective in-use view of an embodiment of the disclosure.

With reference now to the drawings, and in particular to FIGS. 1 through 4 thereof, a new drying device embodying the principles and concepts of an embodiment of the disclosure and generally designated by the reference numeral 10 will be described.

As best illustrated in FIGS. 1 through 4, the shoe drying assembly 10 generally comprises a panel 12 that may have a shoe 14 placed thereon. The panel 12 may engage an inner wall 16 of a dryer 18 thereby inhibiting the shoe 14 from tumbling when the dryer 18 is turned on. The shoe 14 may be a tennis shoe or the like. The dryer 18 may be a clothes dryer or the like. The panel 12 may be comprised of a bendable material such as rubber or the like.

The panel 12 has a top surface 20, a bottom surface 24 and a peripheral edge 26 extending between the top surface 20 and the bottom surface 24. The peripheral edge 26 has a first side 28 and a second side 30. The top surface 20 has a well 32 extending downwardly therein. Thus, the well 32 may have the shoe 14 positioned therein. The well 32 is substantially coextensive with the top surface 20. Each of the first side 28 and the second side 30 curve inwardly proximate a center 34 of the panel 12 such that the panel 12 has a bean shape.

A coupler 36 is coupled to the panel 12. The coupler 36 is positioned on the bottom surface 24 and the coupler 36 substantially covers the bottom surface 24. The coupler 36 may be comprised of a magnetic material. Thus, the coupler 36 may magnetically engage the inner wall 16 of the dryer 18.

A first set of straps 38 is provided and each of the first set of straps 38 is coupled to the panel 12. Each of the first set of straps 38 may be positioned over the shoe 14 when the shoe 14 is positioned in the well 32. Each of the first set of straps 38 is positioned on the first side 28. The first set of straps 38 is space apart from each other. Each of the first set of straps 38 has a distal end 40 with respect to the first side 28.

A pair of first fasteners 42 is provided. Each of the first fasteners 42 is coupled to an associated one of the first set of straps 38. Each of the first fasteners 42 is positioned adjacent to the distal end 40 of the associated first set of straps 38. Each of the first fasteners 42 may comprise hook and loop fasteners or the like.

A second set of straps 44 is provided and each of the second set of straps 44 is coupled to the panel 12. Each of the second set of straps 44 may be positioned over the shoe 14 when the shoe 14 is positioned in the well 32. Each of the second set of straps 44 is matable with an associated one of the first set of straps 38. Thus, the first set of straps 38 and the second set of straps 44 retain the shoe 14 on the panel 12. Each of the second set of straps 44 is positioned on the second side 30 and the second set of straps 44 is spaced apart from each other. Each of the second set of straps 44 has a distal end 45 with respect to the second side 44.

A pair of second fasteners 46 is provided. Each of the second fasteners 46 is coupled to an associated one of the second set of straps 44. Each of the second fasteners 46 is positioned adjacent to the distal end 45 of the associated second set of straps 44. Each of the second fasteners 46 may comprise a hook and loop fastener or the like.

In use, the shoe 14 is positioned in the well 32. The first set of straps 38 and the second set of straps 44 are mated to each other to retain the shoe 14 on the panel 12. The panel 12 is placed within the dryer 18 such that the coupler 36 magnetically engages the inner wall 16 of the dryer 18. The dryer 18 is turned on and the shoe 14 is dried.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A shoe drying assembly comprising:

a panel being configured to have a shoe placed thereon, said panel being configured to engage an inner wall of a dryer thereby inhibiting the shoe from tumbling when the dryer is turned on, wherein said panel has a top surface, a bottom surface and a peripheral edge extending between the top surface and the bottom surface, said peripheral edge having a first side and a second side, said top surface having a well extending downwardly therein wherein said well is configured to have the shoe positioned therein, said well being substantially coextensive with said top surface, each of said first side and said second side curving inwardly proximate a center of said panel such that said panel has a bean shape;

a coupler being coupled to said panel wherein said coupler is configured to magnetically engage the inner wall of the dryer;

a first set of straps, each of said first set of straps being coupled to said panel wherein each of said first set of straps is configured to be positioned over the shoe when the shoe is positioned on said panel; and a second set of straps, each of said second set of straps being coupled to said panel wherein each of said second set of straps is configured to be positioned over the shoe when the shoe is positioned on said panel, each of said second set of straps being matable with an associated one of said first set of straps wherein said first set of straps and said second set of straps is configured to retain the shoe on said panel.

2. The assembly according to claim 1, wherein said coupler is positioned on said bottom surface, said coupler substantially covering said bottom surface.

3. The assembly according to claim 1, wherein:

said panel has a first side; and each of said first set of straps being positioned on said first side, said first set of straps being space apart from each other, each of said first set of straps having a distal end with respect to said first side.

4. The assembly according to claim 1, wherein:

said panel has a second side; and each of said second set of straps being positioned on said second side, said second set of straps being space apart from each other, each of said second set of straps having a distal end with respect to said second side.

5. A shoe drying assembly comprising:

a panel being configured to have a shoe placed thereon, said panel being configured to engage an inner wall of a dryer thereby inhibiting the shoe from tumbling when the dryer is turned on, said panel having a top surface, a bottom surface and a peripheral edge extending between the top surface and the bottom surface, said peripheral edge having a first side and a second side, said top surface having a well extending downwardly therein wherein said well is configured to have the shoe positioned therein, said well being substantially coextensive with said top surface, each of said first side and said second side curving inwardly proximate a center of said panel such that said panel has a bean shape;

a coupler being coupled to said panel, said coupler being positioned on said bottom surface, said coupler substantially covering said bottom surface, said coupler being configured to magnetically engage the inner wall of the dryer;

a first set of straps, each of said first set of straps being coupled to said panel wherein each of said first set of straps is configured to be positioned over the shoe when the shoe is positioned in said well, each of said first set of straps being positioned on said first side, said first set of straps being space apart from each other, each of said first set of straps having a distal end with respect to said first side; and a second set of straps, each of said second set of straps being coupled to said panel wherein each of said second set of straps is configured to be positioned over the shoe when the shoe is positioned in said well, each of said second set of straps being matable with an associated one of said first set of straps wherein said first set of straps and said second set of straps is configured to retain the shoe on said panel, each of said second set of straps being positioned on said second side, said second set of straps being space apart from each other, each of said second set of straps having a distal end with respect to said second side.

* * * * *